US005269029A

United States Patent [19]

Spears et al.

[11] Patent Number: 5,269,029

[45] Date of Patent: Dec. 14, 1993

[54] HYDROTHERAPY JET WITH PUSH-PULL FLOW ADJUSTMENT

[75] Inventors: Robert G. Spears, Chatsworth; Francisco Hinojosa, Jr., Palmdale; Eugene M. Gravatt, Valencia; Michael D. Holtsnider, Camarillo, all of Calif.

[73] Assignee: B&S Plastics, Inc., Oxnard, Calif.

[21] Appl. No.: 970,639

[22] Filed: Nov. 2, 1992

[51] Int. Cl.[5] ..... A61H 33/00

[52] U.S. Cl. ..... 4/541.6; 239/417.3

[58] Field of Search ..... 4/541.3, 541.4, 541.5, 4/541.6; 239/417.3, 428.5, 476, 477, 478, 479, 480, 579, 583

[56] References Cited

U.S. PATENT DOCUMENTS

| | | | |
|---|---|---|---|
| 2,359,455 | 10/1944 | Williamson | 239/428.5 |
| 2,738,787 | 3/1956 | Jacuzzi et al. | 4/541.4 |
| 3,025,006 | 3/1962 | Maurath | 239/417.3 X |
| 4,742,965 | 5/1988 | Messinger et al. | 4/541.6 X |
| 5,095,558 | 3/1992 | Howard | 4/541.6 |

FOREIGN PATENT DOCUMENTS

| | | | |
|---|---|---|---|
| 0168823 | 1/1986 | European Pat. Off. | 4/541.6 |
| 0311967 | 4/1989 | European Pat. Off. | 4/541.6 |
| 0372642 | 6/1990 | European Pat. Off. | 4/541.6 |
| 3939665 | 7/1990 | Fed. Rep. of Germany | 4/541.6 |

*Primary Examiner*—Robert M. Fetsuga
*Attorney, Agent, or Firm*—Koppel & Jacobs

[57] ABSTRACT

A hydrotherapy jet has a push-pull adjustment that enables a discharge to be turned off or on without rotating the discharge nozzle. This allows an off-axis discharge, useful for a neck massage, to be maintain in a constant direction despite adjustments in the discharge flow level. Inlets are provided in the rear of the nozzle, with the inlets closed off by a surrounding sleeve when the nozzle is pushed in but exposed to receive a discharge flow when the nozzle is pulled out. The sleeve is carried by a mounting member, with water flow passages to the nozzle inlet formed between the sleeve and its mounting member. The adjustment mechanism is preferably contained within a pivotable eyeball fitting, and air passageways can be added to provide a mixed water/air discharge.

15 Claims, 3 Drawing Sheets

HYDROTHERAPY JET WITH PUSH-PULL FLOW ADJUSTMENT

BACKGROUND OF THE INVENTION

Field of the Invention

This invention relates to hydrotherapy jets in which the volume of flow through the jet is adjustable.

Description of the Related Art

Hydrotherapy jets are used to inject a massaging stream of water, often mixed with air, into a spa, hot tub or bathtub. Many of the jets are provided with an adjustable flow mechanism, allowing the user to select a desired flow volume from zero to fully on. The adjustment mechanism generally involves rotating either the jet's outlet nozzle, or a face plate that surrounds the outlet nozzle. In the latter arrangement, rotating the face plate also causes the outlet nozzle to rotate.

Since the water/air mixture is discharged from the jet along the axis of the outlet nozzle, the fact that the nozzle is rotated to adjust the flow does not impair the jet's operation; it continues to discharge its flow in the same direction. However, if it were desired to direct the discharge at an off-axis angle to the outlet nozzle, then rotating the nozzle would change the discharge direction. This would be a problem if it were desired to maintain the same discharge direction for all flow settings.

SUMMARY OF THE INVENTION

The present invention seeks to provide a hydrotherapy jet which provides an off-axis directional discharge from an outlet nozzle, and yet has a simple flow adjustment mechanism that allows the nozzle to be manipulated to select a desired flow rate without changing the discharge direction.

The invention is particularly applicable to a jet that is installed towards the upper end of a spa wall, in the vicinity of the user's neck, and has an outlet that redirects the flow from a horizontal nozzle to an upward direction, thus providing a pleasing massage effect for the back of the user's neck. Rather than rotating the nozzle to adjust the flow rate, a simple and convenient axial push-pull nozzle mechanism is used for this adjustment. Since the adjustment does not involve any rotation of the nozzle around its axis, the upward-directed flow is preserved. Also, the elimination of a rotatable face plate allows for a simpler and more compact jet design.

In a preferred embodiment the discharge nozzle has a water inlet formed at the rear of its tubular side wall. The rear of the nozzle lodges in a sleeve that closes off the nozzle's water inlet when the nozzle is pushed in to a rearward position. Pulling the nozzle out to a forward position moves its water inlet forward of the sleeve, allowing water to flow through the jet and out the discharge nozzle. The sleeve is preferably carried by a perpipheral mounting member, and held inward from the mounting member by spacers that allow water to flow between the sleeve and its mounting member to the area just forward of the sleeve; this provides a path for water flow into the nozzle in its forward position. The back of the sleeve is closed off by a rear wall in this configuration to restrict the water flow to the nozzle's side inlet.

The sleeve mounting member preferably forms a rear portion of an eyeball fitting, and is mated with a front fitting that completes the eyeball. Front and rear retainer members hold the eyeball in place and provide bearing surfaces for its rotation. The front eyeball fitting includes a tube that surrounds a portion of the outlet nozzle, and pivots along with the nozzle to pivot the eyeball when the nozzle is pivoted. The front eyeball fitting also includes a stop that engages a lip on the nozzle, limiting the nozzle's forward motion when it is pulled out to open the water discharge path.

The nozzle includes an outlet at its forward end that includes an opening through which water is discharged from the nozzle at an off-axis angle. A finger grip forward of the outlet opening is gripped by the user to push the nozzle in to shut off the water flow, pull it out to open the water flow, or set it to an intermediate position for a partial flow. This adjustment is made without rotating the nozzle around its axis, and thus does not require any change in the direction of the discharge. An air flow can be added to the water discharge if desired.

Further features and advantages of the invention will be apparent to those skilled in the art from the following detailed description, taken together with the accompanying drawings.

BRIEF DESCRIPTION OF THE DRAWINGS

FIGS. 1 and 2 are respectively sectional and exploded perspective views of a hydrotherapy jet in accordance with the invention, with the jet in an off position in FIG. 1;

DETAILED DESCRIPTION OF THE INVENTION

Figure 1:
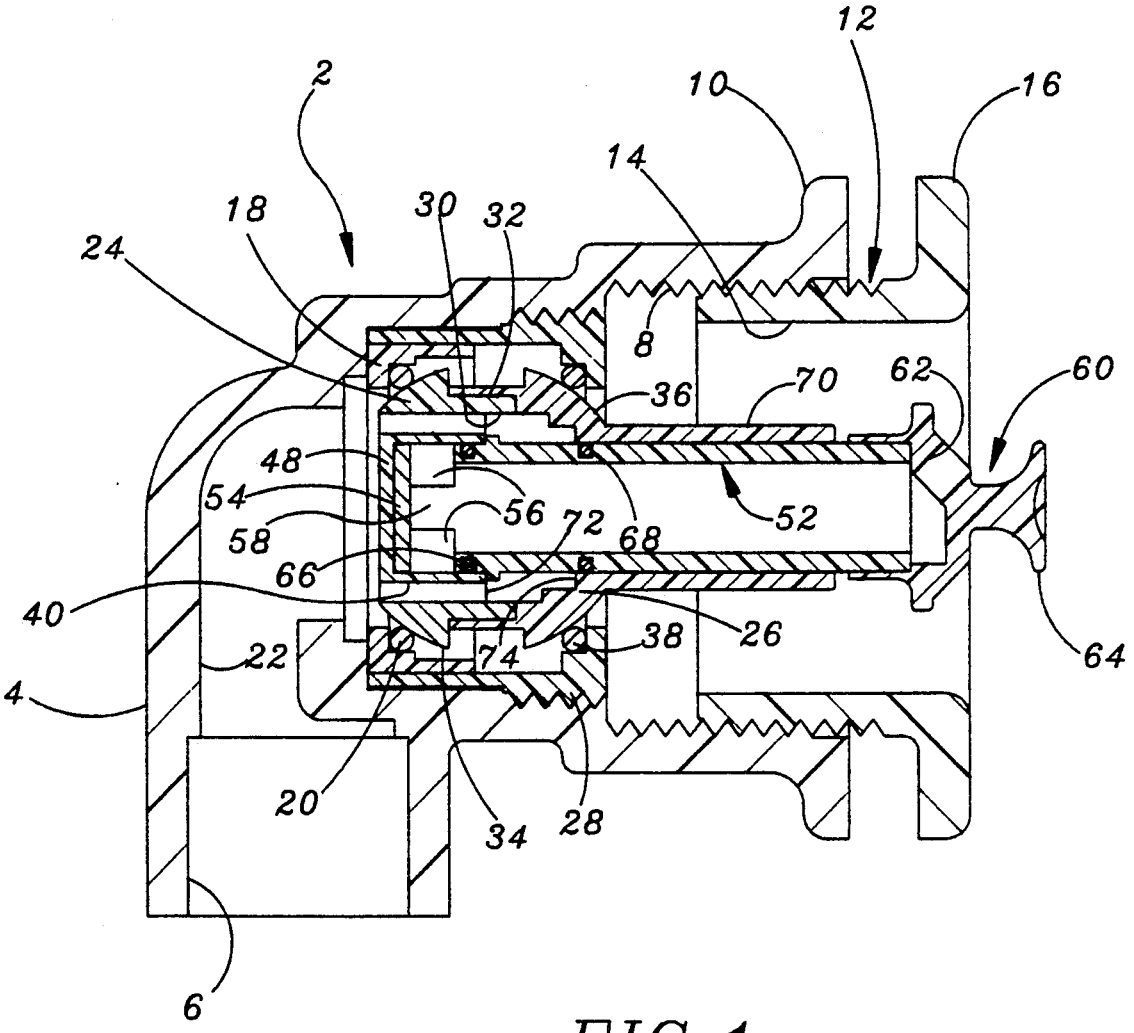

A preferred embodiment for the new jet, shown in FIGS. 1 and 2, includes a housing 2 that has a water inlet pipe 4 with an interior socket 6 that receives a standard water supply tube. The jet and its components are preferably formed from a water impervious plastic such as ABS. It is particularly adapted to be positioned near the upper end of a spa wall, with the water supply pipe 4 positioned behind the spa's water contacting wall and directed vertically downward to receive a water supply tube from the rest of the spa plumbing. The housing has an inside threaded cavity 8 that opens toward the interior of the spa, with a flange 10 at the forward end of the cavity. A wall mounting 12 includes a threaded tube 14 that is inserted from inside the spa through an opening in the spa wall, and threads into the housing cavity 8. The wall mounting is screwed into the housing cavity until a flange 16 on the wall mounting tightens against the spa wall, holding the jet securely in place with the spa wall sandwiched between the cavity and wall mounting flanges 10 and 16.

A bearing ring 18 is positioned at the rear of the housing cavity, and includes a wear ring 20 lodged in its inside corner. A water passageway 22 extends up through the jet housing from the water inlet socket 6, turning to a horizontal orientation to provide a water flow into the cavity 8. The bearing ring 18 is open, allowing water from the housing's water inlet to flow through the ring.

The jet includes an eyeball outlet mechanism, consisting of rear and front eyeball fittings 24 and 26, with a retainer member 28 holding the eyeball fitting in place within the jet cavity. The rear eyeball fitting 24 includes a tubular forward extending cylinder 30 that nests within a tubular rearward extending cylinder 32 on the front eyeball fitting to hold the two fittings together. The rear eyeball fitting has a rounded, generally rearward facing outer surface 34, while the front eyeball fitting has a rounded, generally forward facing outer surface 36. The rear fitting's rounded surface bears against the wear ring 20, while the front fitting's rounded surface bears against a wear ring 38 that is lodged within recess in the retainer 28. The eyeball fitting can thus pivot about its center, with the wear rings 20 and 38 bearing against the curved surfaces 34 and 36 of the rear and front eyeball fittings to hold the eyeball in place once it has been pivoted to a desired orientation.

Figure 3:
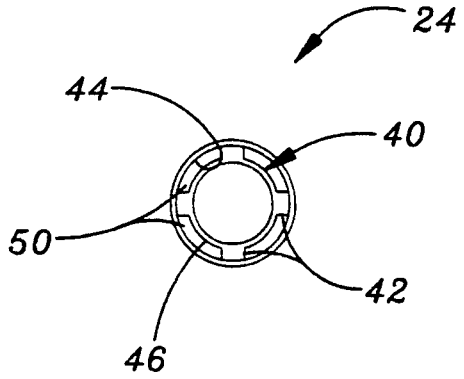
FIG. 3 is an enlarged side elevation view of the sleeve used to control the flow of water into the outlet nozzle, and of its associated mounting member.
Figure 5:
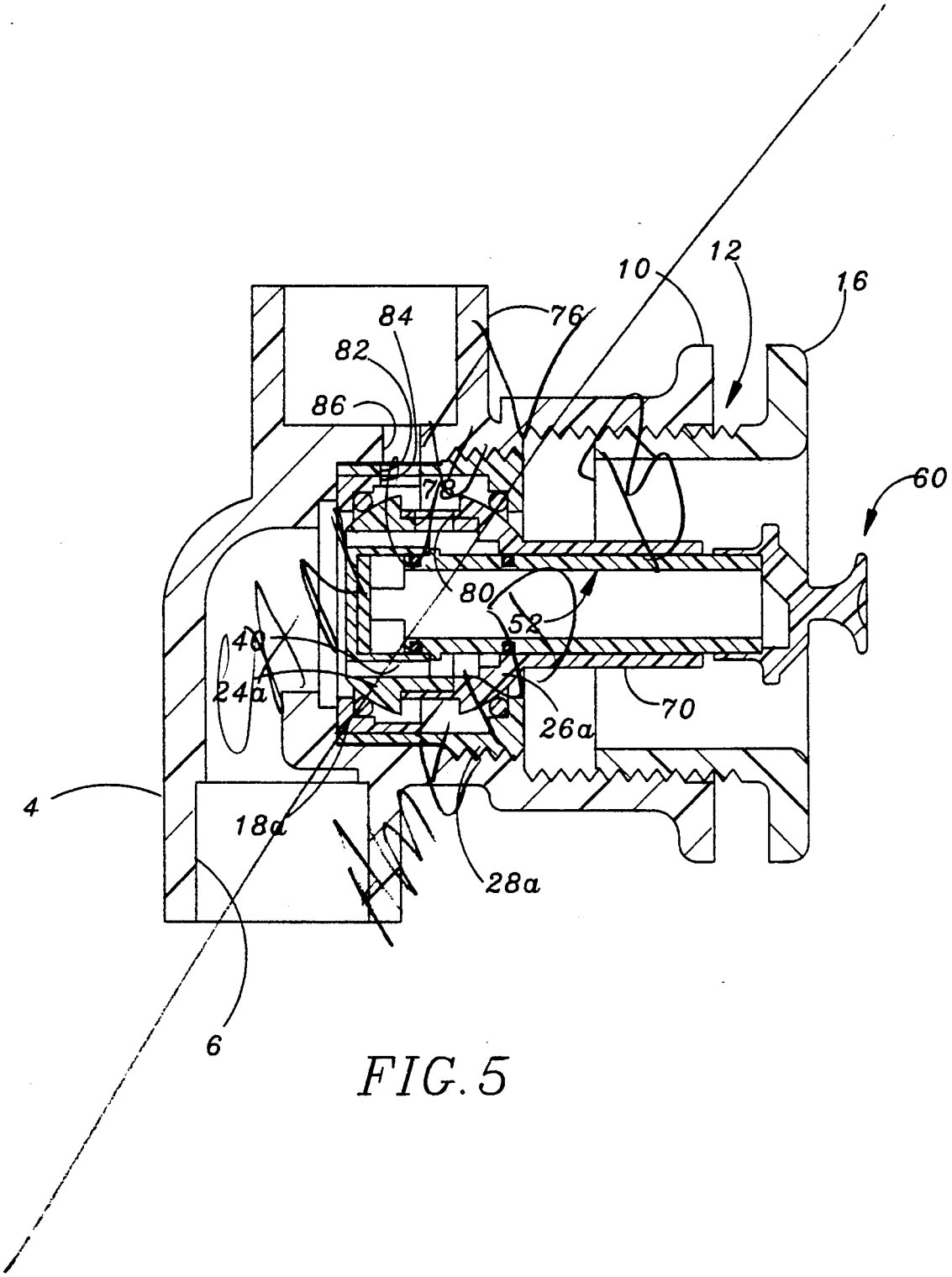

Referring to FIG. 3, an interior sleeve 40 is mounted within the rear eyeball fitting 24 by means of spacer ribs 42 that extend from the interior fitting surface 44 to the exterior sleeve surface 46; the eyeball fitting, sleeve and spacers are preferably formed as an integral molded part. The back of the sleeve is closed by a rear wall 48 (shown in FIG. 1). With the sleeve 40 spaced radially inward of the surrounding eyeball fitting 24, water flow paths are formed from the jet's water passageway 22 to the area immediately forward of and adjacent to the sleeve by the openings 50 between the inner fitting surface 44, the outer sleeve surface 46 and the sleeve mounting spacer ribs 42.

A water discharge nozzle 52 for the jet has an open position at which it discharges water flowing through the jet housing into the spa or tub, and a closed position at which the water flow is blocked. Shown in its closed position in FIG. 1, the nozzle 52 comprises an elongated tube that is open at its forward end and closed at its rear by a rear wall 54. Immediately forward of the rear wall, a plurality of openings 56 are formed in the nozzle's side wall. The remainder of the side wall between the openings 56 forms ribs 58 that hold the rearwall 54 set back from the rest of the nozzle, and assist in guiding the nozzle through the sleeve when the nozzle is axially adjusted, as described below. With the nozzle in its open position, water flows into the inlets 56 and out through the front of the nozzle. An outlet 60 is mounted over the front end of the nozzle and preferably glued in place. The outlet closes off the end of the nozzle, except for an off-axis opening 62 through which the discharge is directed at an angle to the nozzle axis. With this opening directed upward at about a 45° angle as shown in FIG. 1 and the jet positioned slightly below the level of the user's neck, a massaging water flow is directed onto the back of the neck. The outlet includes a finger grip 64 that extends forward of the opening 62 out of the water discharge path, and is shaped to be easily gripped by the user's fingers to push the nozzle into a closed position or pull it out to an open position.

In the closed position shown in FIG. 1, the nozzle 52 is pushed inward so that its rear water inlets 56 are completely surrounded by the sleeve 40. The outside nozzle diameter is nearly equal to the inner sleeve diameter. An O-ring 66 is lodged in a recess in the outer nozzle wall just forward of inlets 56 to seal off any flow of water into the nozzle, and also facilitates an axial movement of the nozzle used to set it to an open position. A second O-ring 68 is lodged in a recess in the outer nozzle wall adjacent the front eyeball fitting 26, and further facilitates an axial nozzle movement.

Figure 4:
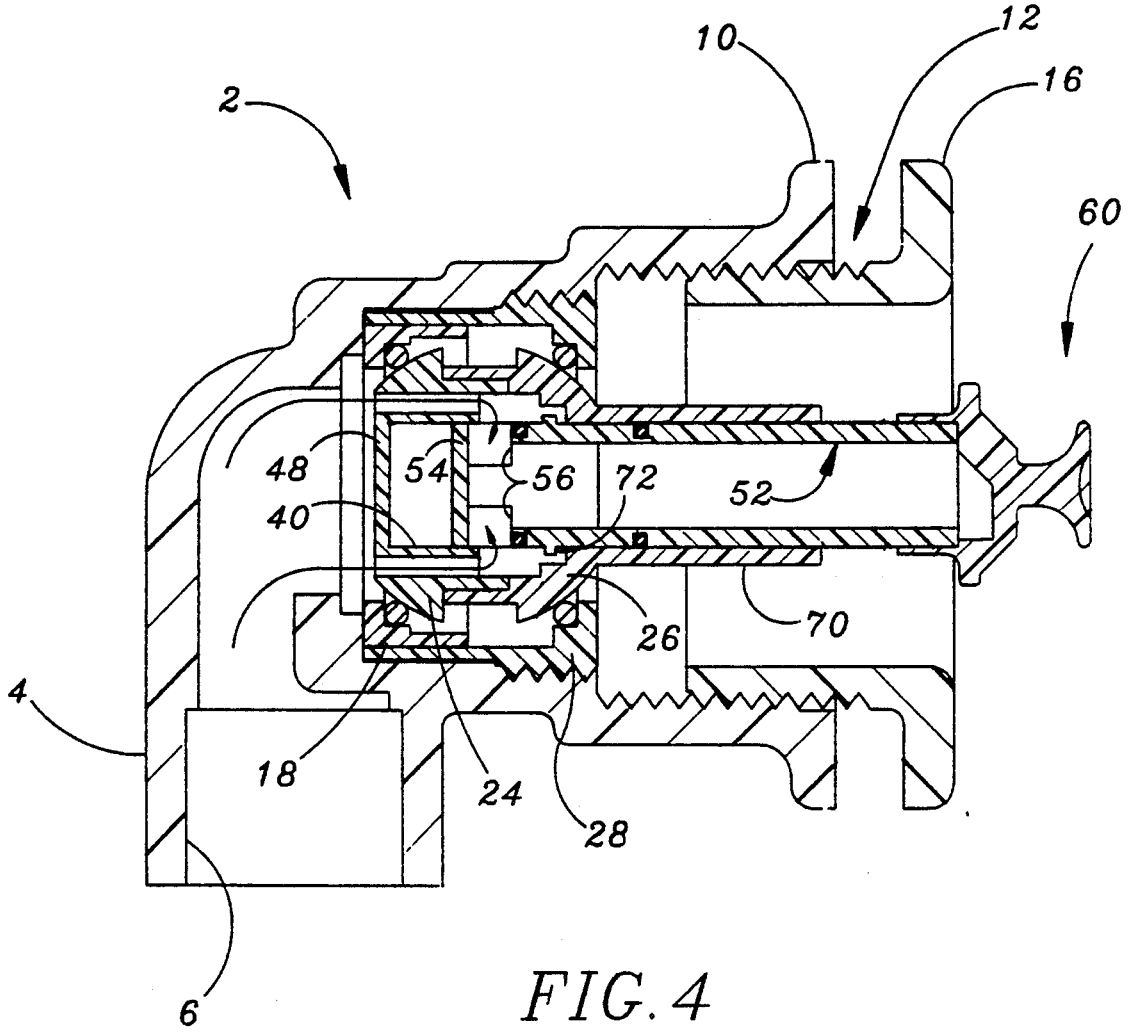
FIG. 4 is a sectional view similar to FIG. 1, but with the jet's outlet nozzle in an open position.

The front eyeball fitting 26 includes a forward extending tubular section 70 that surrounds the nozzle and terminates slightly to the rear of the outlet 60. The tube 70 assists in keeping the outlet nozzle aligned with the pivoted position selected for the eyeball fitting, and also translates a pivoting force applied to the nozzle through the finger grip 64 to a pivoting of the entire eyeball fitting The jet is shown with the nozzle 52 pulled out to its open position in FIG. 4. In this FIGURE the nozzle water inlets 56 are positioned just forward of the sleeve 40, allowing water flowing through the passages 50 on the exterior of the sleeve to continue through the nozzle and out through the directional outlet opening 62. A lip 72 around the periphery of the nozzle immediately forward of O-ring 66 strikes a stop surface 74 formed in the interior of the front eyeball fitting 26 to limit the nozzle's forward movement.

The operation of the jet is very simple. The user grasps the finger grip 64 and pulls the nozzle out to obtain a full flow, pushes the nozzle in to shut off the flow, or positions the nozzle at an intermediate position to obtain a partial flow. While such adjustments are normally performed without rotating the nozzle, the nozzle can be easily rotated about its axis if it is desired to change the discharge direction. Also, the nozzle can be pivoted via the eyeball fitting to adjust the discharge angle.

While particular embodiments of the invention have been shown and described, numerous variations and alternate embodiments will occur to those skilled in the art. Accordingly, it is intended that the invention be limited only in the terms of the appended claims.

We claim:

1. A hydrotherapy jet, comprising:

a hollow jet housing having a conduit for admitting water into the housing, an elongate nozzle providing a water outlet from the housing, said nozzle extending forward from the jet housing, being grippable by a user and including a lateral water inlet that is formed integrally as a part of said nozzle, means mounted within said housing for supporting said nozzle within said housing with the nozzle position being adjustable by sliding the nozzle axially relative to said supporting means, and means responsive to an axial adjustment of said nozzle for altering a flow of water from said housing conduit into said water inlet by closing the water inlet when the nozzle is pushed inward towards the jet housing, and opening the water inlet when the nozzle is pulled outward from the jet housing.

2. The hydrotherapy jet of claim 1, wherein said means for supporting said nozzle includes an eyeball fitting that is captured within said housing and allows the nozzle direction to be adjusted.

3. A hydrotherapy jet, comprising:

a jet housing, a sleeve having opposite open and closed ends and water impervious side walls between said ends, means for mounting said sleeve within said jet housing with said open end facing generally forward, with a water supply passage through said housing extending around said sleeve to provide a water supply to an area adjacent to the open end of said sleeve, and an elongate nozzle having opposed ends, with a water outlet at one end and a lateral water inlet at the other end, said nozzle being slidably axially adjustable between a closed position at which its water inlet is lodged within said sleeve and blocked by said sleeve from receiving a flow of water from said water passageway, and an open position at which the nozzle's water inlet is not blocked by said sleeve, said nozzle in its open position receiving a water flow from said water passageway and discharging said water flow through its outlet.

4. The hydrotherapy jet of claim 3, said sleeve mounting means comprising a mounting member having a cylindrical inner surface that faces and is spaced radially outward from said sleeve, and a plurality of spacer members spacing the sleeve radially inward of the mounting member, said spacer members defining water flow paths between said mounting member and sleeve for said water supply passage.

5. The hydrotherapy jet of claim 4, said sleeve mounting member comprising an eyeball fitting through which said nozzle extends, said eyeball fitting having a rounded rear portion with said cylindrical inner surface provided internally within said rear eyeball portion.

6. The hydrotherapy jet of claim 4, said sleeve mounting member having a rounded generally rearward facing exterior surface, and further comprising a bearing member within said housing that provides a bearing surface for said rounded surface, allowing said nozzle and mounting member to be pivoted to adjust the axial direction of said nozzle.

7. A hydrotherapy jet, comprising:

a jet housing, a sleeve having an open end, water impervious sleeve side walls, and a closed end opposite to its open end, means for mounting said sleeve within said jet housing with said open end facing generally forward, with a water supply passage through said housing external to said sleeve providing a water supply to an area adjacent said sleeve, said sleeve mounting means comprising a mounting member having a cylindrical inner surface that faces and is spaced radially outward from said sleeve, and a plurality of spacer members spacing the sleeve radially inward of the mounting member, said space members defining water flow paths between said mounting member and sleeve for said water supply passage, an elongate nozzle having opposed ends, with a water outlet at one end and a water inlet at the other end, said nozzle being axially adjustable between a closed position at which its water inlet is lodged within said sleeve and blocked by said sleeve from receiving a flow of water from said water passageway, and an open position at which the nozzle's water inlet is not blocked by said sleeve, said nozzle in its open position receiving a water flow from said water passageway and discharging said water flow through its outlet, said sleeve mounting member having a rounded generally rearward facing exterior surface, and further comprising a bearing member within said housing that provides a bearing surface for said rounded surface, allowing said nozzle and mounting member to be pivoted to adjust the axial direction of said nozzle, and a front fitting that engages said sleeve mounting member around said nozzle, said front fitting having a generally forward facing rounded surface, and a front retainer member held in said housing, said front retainer member including a bearing surface that bears against the rounded surface of said front fitting, said bearing member and front retainer member retaining said sleeve mounting member and front fitting between them in an eyeball configuration.

8. The hydrotherapy jet of claim 7, said front fitting including a forward extending tube that surrounds said nozzle rearward of the nozzle's outlet, said tube pivoting along with said nozzle to rotate said sleeve mounting member and front fitting when said nozzle is gripped at its forward end and pivoted.

9. The hydrotherapy jet of claim 7, said nozzle including a peripheral lip forward of its water inlet, said front fitting including a stop which engages said lip to limit the forward axial movement of said nozzle.

10. The hydrotherapy jet of claim 7, said sleeve mounting member including a forward extending tube and said front fitting including a rearward extending tube that nests with said tube on the sleeve mounting member to hold the sleeve mounting member and front fitting together.

11. The hydrotherapy jet of claim 10, said housing including an air inlet, and said front retainer member and said tubes on the sleeve mounting member and front fitting having aligned openings to provide an air passageway from said air inlet to the nozzle's water inlet.

12. The hydrotherapy jet of claim 3, said nozzle including side and rear walls, and said nozzle water inlet comprising at least one opening in the nozzle's side wall forward of said rear wall.

13. The hydrotherapy jet of claim 12, said nozzle side wall including a plurality of ribs that span said water inlet and guide the axial movement of said nozzle within said sleeve.

14. The hydrotherapy jet of claim 3, said nozzle including an outlet for emitting water flowing through the nozzle at an off-axis direction, wherein said nozzle is axially and slidably adjustable to alter its water flow rate without rotating the nozzle around its axis, thereby preserving the direction at which water is emitted from the nozzle.

15. The hydrotherapy jet of claim 14, said outlet including an outlet opening, and a finger grip forward of said outlet opening that can be gripped by a user to adjust the nozzle's axial position.

* * * * *